United States Patent [19]

Wright, Christopher B.

[11] Patent Number: 5,024,375

[45] Date of Patent: Jun. 18, 1991

[54] CLOSURE DEVICE FOR RECLOSING A GABLE-TOP CONTAINER

[76] Inventor: Wright, Christopher B., 2299 Pacific Ave., San Francisco, Calif. 94115

[21] Appl. No.: 495,109

[22] Filed: Mar. 19, 1990

[51] Int. Cl.[5] ..... B65D 33/16

[52] U.S. Cl. ..... 229/125.39; 229/125.08

[58] Field of Search ..... 206/621.1, 621.2, 631.3; 229/125.08, 125.11, 125.12, 125.39; 24/30.5 R, 30.5 L; 383/68, 69

[56] References Cited

U.S. PATENT DOCUMENTS

| | | | |
|---|---|---|---|
| 2,152,745 | 4/1939 | Klass | 383/69 |
| 3,217,967 | 11/1965 | Jackson | 229/125.08 |
| 3,381,883 | 5/1968 | Harris | 24/30.5 R |
| 3,458,110 | 7/1969 | Goldman | 229/125.12 |
| 3,463,380 | 8/1969 | Cooperstein | 229/125.08 |
| 3,680,771 | 8/1972 | Blunsdon | 206/631.3 |
| 3,693,864 | 9/1972 | Wilkins | 229/125.12 |
| 4,109,351 | 8/1978 | Coffey | 24/30.5 R |
| 4,619,398 | 10/1986 | Laramie | 229/125.12 |
| 4,793,549 | 12/1988 | Wald | 229/125.39 |

*Primary Examiner*—Gary E. Elkins

*Attorney, Agent, or Firm*—Leighton K. Chong

[57] ABSTRACT

A closure device, for reclosing a gable-top container having a top ridge which is initially sealed and has one side that is openable and can be refolded for reclosure, includes an elongated member having a holding portion and a mounting portion. The holding portion has walls defining an interior channel which has a thickness corresponding to the thickness of the top ridge of the gable top to form a friction fit therewith. The mounting portion is pivotably secured on the top ridge adjacent the openable side of the gable top, so that the elongated member can be pivoted upwards to allow the gable top to be opened and pivoted downwards to hold the top ridge closed. A preferred embodiment has the mounting portion formed with a pair of projections spaced apart by a small gap which allows the projections to be forced over the top ridge and secured in a clasp hole formed in the top ridge.

17 Claims, 1 Drawing Sheet

FIG.1
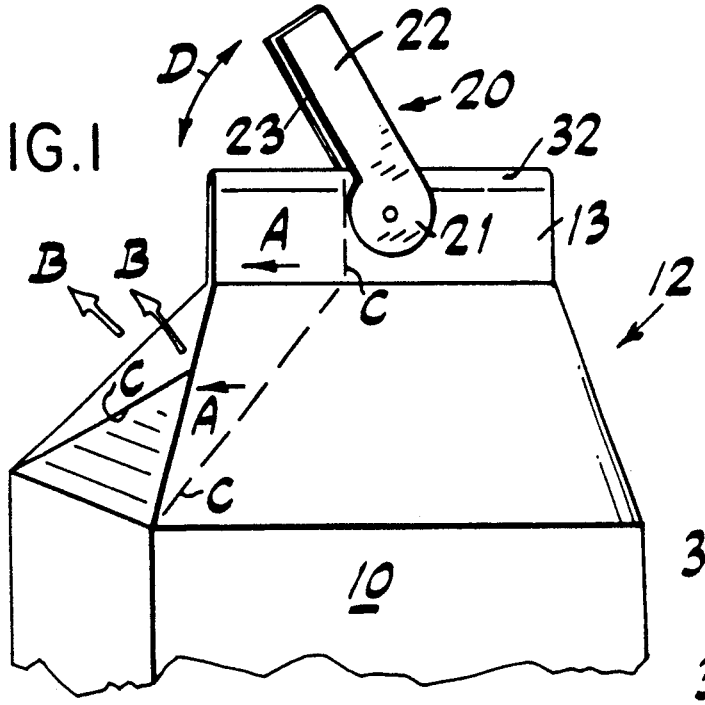
FIG.3
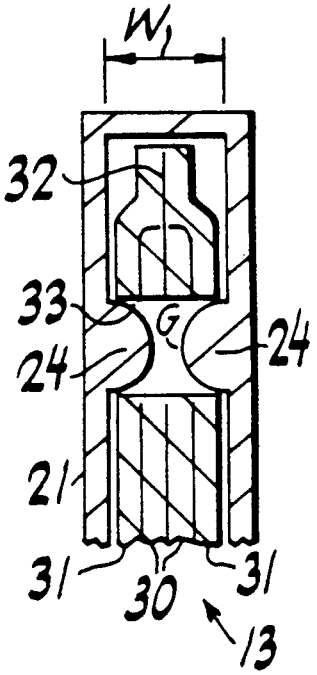
FIG.2A
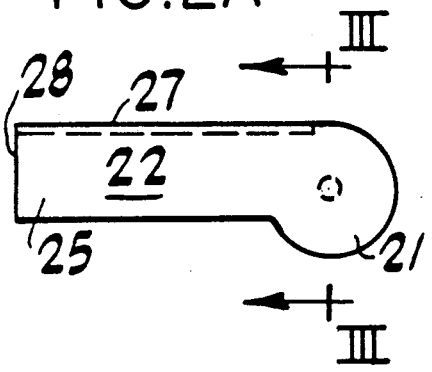
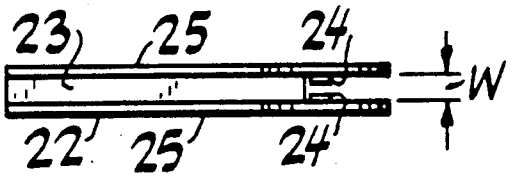
FIG.2B
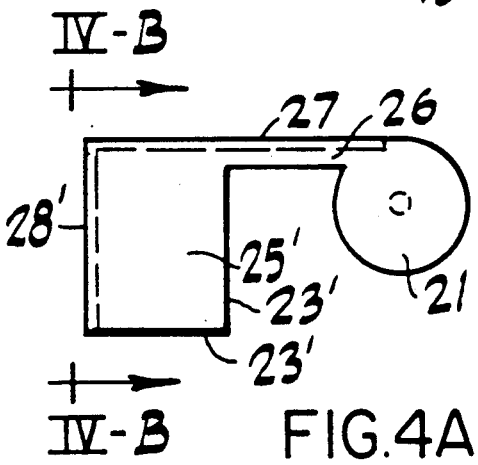
FIG.4A
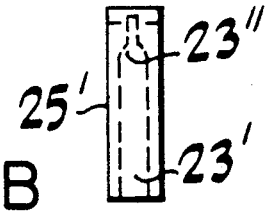
FIG.4B

CLOSURE DEVICE FOR RECLOSING A GABLE-TOP CONTAINER

FIELD OF THE INVENTION

This invention generally relates to a reclosable gable-top container, and particularly to a closure device for allowing the refoldable gable top of a container to be opened and securely reclosed.

BACKGROUND ART

Gable-top containers have been in widespread use for many years. During fabrication and assembly, a cardboard blank is formed into a hollow rectangular shape and one end is sealed. The container is typically filled with a liquid, such as a beverage or juice drink. The top end of the container is then folded into a gable top and the upper ridge thereof is sealed closed. The gable top has certain score lines, and the seal on one side is made less adhesive than the other side, in order to allow the container to be opened by separating the seal of the ridge on the less secure side and opening the cardboard walls outwardly to form a spout for pouring or drinking the liquid contents. The opened side can then be refolded closed along the score lines.

A major difficulty with such gable-top containers is that the refolding of the opened side is only held in place by the folded shape of the cardboard walls, and this does not form a secure reclosure of the container. As a result, reclosed gable-top containers are likely to spill or leak liquid from the opened side, thus presenting an inconvenience to the user.

SUMMARY OF THE INVENTION

It is therefore a principal object of the invention to provide a closure device for a gable-top container which allows the container to be reclosed in a manner which securely prevents the liquid contents from spilling or leaking. It is a further object that such closure device be simple in construction, inexpensive to manufacture, and readily installable on a gable-top container.

In accordance with the present invention, a closure device for reclosing a gable-top container, of the type having container walls defining a refoldable gable top and a top ridge of a given length and width, the top ridge being initially sealed and having one side thereof openable such that the gable top of the container can be unfolded on the one side into a spout and refolded for reclosure, comprises an elongated member having a holding portion including walls defining an interior channel which has a width corresponding to the width of the top ridge of the gable top and is open on a bottom side thereof facing toward the top ridge, and a mounting portion at one end thereof which is pivotably secured onto the top ridge at an intermediate position adjacent and clear of the openable one side of the gable top, wherein said elongated member is pivoted upwards to allow the openable one side of the gable top to be initially opened or reopened, and pivoted downwards to engage the refolded top ridge on the openable one side in a friction fit in the interior channel of the elongated member to securely hold the top ridge closed.

In preferred embodiments of the invention, the pivotable mounting portion consists of a pair of projections facing toward each other from opposing walls of the elongated member which are spaced apart by a small gap which allows the projections to be forced over the folded container walls of the top ridge and secured in a clasp hole formed in the top ridge, so that the closure device can be initially installed on the container and left in position for use with the container. Alternatively, the container may be formed with the clasp hole, and a user may employ such a closure device and remove it for further use when the container has been expended.

The closure device may have any suitable configuration which allows the top ridge to be secured by a friction fit of the interior channel over the refolded top ridge. For example, the closure member may have bar-shaped rectangular walls which are spaced apart by the width of the interior channel and have a length matched to the width of the openable one side of the gable top to be secured. Alternatively, the closure device may have the friction-fit interior channel formed by a flag-shaped portion at the other end of the elongated member connected to the mounting portion by a stem. The interior channel may also have compound channel widths matched to the actual configuration of the standard gable top container.

Other objects, features and advantages of the present invention will be apparent from the following detailed description of the preferred embodiments with reference to the drawings, of which:

BRIEF DESCRIPTION OF THE DRAWINGS

FIG. 1 is a perspective view of a gable-top container and closure device in accordance with the invention.

FIG. 2A is a side view of one embodiment of the closure device.

FIG. 2B is a top cross-sectional view of the embodiment of FIG. 2A.

FIG. 3 is an enlarged, end cross-sectional view of the embodiment of FIG. 2A, taken along view lines III—III, as installed on the top ridge of the container.

FIG. 4A is a side view of another embodiment of the closure device.

FIG. 4B is an end, cross-sectional view of the embodiment of FIG. 4A taken along view lines IVA—IVA.

DETAILED DESCRIPTION OF THE INVENTION

Referring to FIG. 1, a gable-top container 10 of the type widely used for beverage containers has a gable top 12 which terminates in a top ridge 13. The container is typically made from a cardboard blank having a surface film of wax or plastic, with its lower end sealed, and its upper end folded into the gable top 12 sealed along the top ridge 13. The gable top has one side "A" which is openable into a spout, as indicated by the arrows "B", by opening the seal of the top ridge on side "A" and unfolding the container walls along score and/or fold lines "C". The gable top is reclosed conventionally by refolding the container walls to their initial configuration and relying on the folded condition thereof to hold the container closed.

In accordance with the invention, a closure device comprises an elongated member 20 having a mounting portion 21 at one end which is pivotably secured at an intermediate position on the top ridge 13 adjacent and clear of the openable side "A". The elongated member 20 has a holding portion 22 with walls defining an interior channel 23 which is secured over the openable side "A" of the top ridge 13 by a friction fit. The closure member 20 is pivoted upward and downward in the direction of arrows "D" to allow the one side of the gable top to be initially opened or reopened and to securely hold the top ridge closed when the gable top is refolded.

The closure member 20 may have any suitable configuration which allows the top ridge 12 to be secured by a friction fit of the interior channel 23 over the refolded top ridge. For example, in the embodiment of FIGS. 2A and 2B, the mounting portion 21 may be formed in a circular shape to facilitate pivoting. The member 20 may be formed with metal walls spaced apart by an interior channel of a width "W" which corresponds to the width of the top ridge on which it is secured. The metal walls of the mounting portion 21 can be indented by metal stamping to form two embossed projections 24 which are used to clasp onto the top ridge, as described in greater detail below. The holding portion 22 of the member 20 may be formed with bar-shaped rectangular walls 25 which have a length matched to the length of the openable one side of the gable top to be secured.

Alternatively, as shown in the embodiment of FIGS. 4A and 4B, the closure device 20 may have the friction-fit interior channel 23' formed by flag-shaped walls 25' which are connected to the mounting portion 21 by a stem 26. The stem may be configured to lie on top of the upper edge of the top ridge 13, while the openable side "A" of the top ridge is secured at the end thereof by the flag-shaped portion 25'. The interior channel 23, 23' is open on the side facing toward the top ridge, however, the top edge 27 of the closure member may also be open, while the walls 25, 25'are connected by the side edge 28, 28'. Such a construction would be useful for accomodating top ridges of varying height. On the other hand, the top edge 27 may be closed and serve to connect the walls 25, 25'together, while the side edge 28, 28'is open. Such a construction would be useful for accomodating top ridges of varying length. As an alternative arrangement, the holding portion may be formed simply as a pair of spring legs 25, 25' connected by the side edge 28, 28', with the mounting portion 21 applying pressure to the top ridge by the spring force of the legs. The closure member may also be formed from molded plastic.

In FIG. 3, an enlarged detailed view of the mounting portion 21 is shown installed on a conventional top ridge 13. In the typical gable-top container, the lateral walls 30 on the short side of the rectangular container have a height slightly less than the height of the longitudinal walls 31 on the long side. This allows the walls on the long side to extend above the walls on the short side so that they can be sealed together at the edge 32 of the top ridge 13. Referring to FIG. 1, the walls on the short side of the container are not sealed at the top ridge of the openable side "A", while they are additionally sealed on the non-openable side. This makes it easier for the consumer to open the openable side "A", and to allow the non-openable side to remain securely sealed. The width W of the interior channel 23 is thus selected to form a friction fit over the thicker part of the top ridge including the four layers of the doubled over walls 30 of the short side and the walls 31 of the long side.

In the preferred mode of using the invention, the container fabricator punches a clasp hole 33 through the thicker part of the top ridge 13, and installs the closure device 20 with each container by seating the projections 24 in the clasp hole 33. The projections are formed spaced apart by a gap "G" which, in conjunction with the flexibility of the plastic or metal walls 25, 25' of the closure member 20, allows the projections 24 to be forced over the thicker part of the top ridge and seated in the clasp hole 33. As a further alternative, the fabricator may form the mounting portion with a plastic pin through the mounting hole that is welded or glued to the walls of the holding portion 22.

In an alternative mode, the fabricator merely punches the clasp hole, and the consumer installs the closure device 20 on the container and removes it when the container is expended. The closure device may also be used when no clasp hole is provided by the fabricator, although the pressure of the projections 24 on the thicker part of the top ridge will result in greater friction inhibiting the pivotal movement. As shown in FIG. 4B, the interior channel 23', 23" may be formed with compound widths to accomodate both the thicker part and the top edge 32 of the top ridge.

Although the invention has been described with reference to certain preferred embodiments, it will be appreciated that many variations and modifications may be made consistent with the broad principles of the invention. It is intended that the preferred embodiments and all of such variations and modifications be included within the scope and spirit of the invention, as defined in the following claims.

I claim:

1. A closure device for use in combination with a gable-top container, of the type having container walls defining a refoldable gable top, the gable top having folded container walls defining a top ridge formed on a top side of the gable top having one openable side of a given length and width and a non-openable side opposite from said openable side, the top ridge being initially sealed and capable of having the one openable side thereof opened such that the gable top of the container can be unfolded on the one openable side into a spout and refolded for reclosure, comprising:

an elongated member having a holding portion and a mounting portion, said holding portion including walls defining an interior channel which has a width corresponding to the width of the top ridge of the container and a length matched to the length of the one openable side of the top ridge, said interior channel being open on a bottom side of the elongated member adapted to face toward the top ridge, and said mounting portion being formed at one end of the elongated member and being pivotably secured onto the top ridge at an intermediate position thereof adjacent and clear of the one openable side of the top ridge, wherein said elongated member is pivoted upwards to allow the one openable side of the top ridge to be initially opened or reopened, and pivoted downwards to engage the refolded top ridge on the one openable side in a friction fit in the interior channel of the elongated member to securely hold the top ridge closed.

2. A closure device for use in combination with a gable-top container, of the type having container walls defining a refoldable gable top, the gable top having folded container walls defining a top ridge formed on a top side of the gable top having one openable side of a given length and width and a non-openable side opposite from said openable side, the top ridge being initially sealed and capable of having the one openable side thereof opened such that the gable top of the container can be unfolded on the one openable side into a spout and refolded for reclosure, comprising:

an elongated member having a holding portion and a mounting portion, said holding portion including walls defining an interior channel which has a width corresponding to the width of the top ridge of the container, said interior channel being open on a bottom side of said elongated member adapted to face toward the top ridge, and said mounting portion being formed at one end of said elongated member and being pivotably secured onto the top ridge at an intermediate position thereof adjacent and clear of the one openable side of the top ridge, wherein said elongated member is pivoted upwards to allow the one openable side of the top ridge to be initially opened or reopened, and pivoted downwards to engage the refolded top ridge on the one openable side in a friction fit in the interior channel of the elongated member to securely hold the top ridge closed, wherein said elongated member has bar-shaped rectangular walls which are spaced apart by the width of the interior channel and have a length matched to the length of the one openable side of the top ridge to be secured.

3. A closure device according to claim 2, wherein said mounting portion includes a pair of projections facing toward each other from opposing walls of the elongated member which are spaced apart by a small gap which allows the projections to be forced over the folded container walls of the top ridge.

4. A closure device according to claim 2, in which a clasp hole is formed in the top ridge at said intermediate position, and said mounting portion includes a pair of projections facing toward each other from opposing walls of the elongated member which are seated in the clasp hole formed in the top ridge.

5. A closure device according to claim 2, wherein said holding portion of the elongated member is formed with flag-shaped walls at an end of the elongated member which is opposite to said one end of said elongated member and is connected to the mounting portion by a stem.

6. A closure device according to claim 2, wherein said interior channel has compound channel widths matched to the actual configuration of the gable-top container.

7. A closure device according to claim 2, wherein said interior channel is open on a top side of the elongated member opposite from the bottom side facing toward the top ridge, while the walls of the holding portion are connected at a distal edge of the elongated member, in order to accomodate top ridges of varying height.

8. A closure device according to claim 2, wherein said walls of the holding portion are connected together along a top side of the elongated member opposite from the bottom side facing toward the top ridge, while a distal edge of the elongated member is open, in order to accomodate top ridges of varying width.

9. A closure device according to claim 2, wherein said holding portion is formed by a pair of spring legs connected at a distal side edge of the elongated member, and said mounting portion is formed by the ends of said spring legs applying pressure to the top ridge by the spring force of the legs.

10. A combination of a gable-top container of the type having container walls defining a refoldable gable top, the gable top having folded container walls defining a top ridge formed on a top side of the gable top having one openable side of a given length and width and a non-openable side opposite from said openable side, the top ridge being initially sealed and capable of having the one openable side thereof opened such that the gable top of the container can be unfolded on the one openable side into a spout and refolded for reclosure, and a closure device for the gable top comprising:

an elongated member having a holding portion and a mounting portion, said holding portion including walls defining an interior channel which has a width corresponding to the width of the top ridge of the container, said interior channel being open on a bottom side of said elongated member adapted to face toward the top ridge, and said mounting portion being formed at one end of said elongated member and being pivotably secured onto the top ridge at an intermediate position thereof adjacent and clear of the one openable side of the top ridge, wherein said elongated member is pivoted upwards to allow the one openable side of the top ridge to be initially opened or reopened, and pivoted downwards to engage the refolded top ridge on the one openable side in a friction fit in the interior channel of the elongated member to securely hold the top ridge closed, wherein said elongated member has bar-shaped rectangular walls which are spaced apart by the width of the interior channel and have a length matched to the length of the one openable side of the top ridge to be secured.

11. A combination of a gable-top container and closure device according to claim 10, wherein said mounting portion includes a pair of projections facing toward each other from opposing walls of the elongated member which are spaced apart by a small gap which allows the projections to be forced over the folded container walls of the top ridge.

12. A combination of a gable-top container and closure device according to claim 10, in which a clasp hole is formed in the top ridge at said intermediate position, and said mounting portion includes a pair of projections facing toward each other from opposing walls of the elongated member which are seated in the clasp hole formed in the top ridge.

13. A combination of a gable-top container and closure device according to claim 10, wherein said holding portion of the elongated member is formed with flag-shaped walls at an end of the elongated member which is opposite to said one end and is connected to the mounting portion by a stem.

14. A combination of a gable-top container and closure device according to claim 10, wherein said interior channel has compound channel widths matched to the actual configuration of the gable-top container.

15. A combination of a gable-top container and closure device according to claim 10, wherein said interior channel is open on a top side of the elongated member opposite from the bottom side facing toward the top ridge, while the walls of the holding portion are connected at a distal edge of the elongated member, in order to accomodate top ridges of varying height.

16. A combination of a gable-top container and closure device according to claim 10, wherein said walls of the holding portion are connected together along a top side of the elongated member opposite from the bottom side facing toward the top ridge, while a distal edge of the elongated member is open, in order to accomodate top ridges of varying width.

17. A combination of a gable-top container and closure device according to claim 10, wherein said holding portion is formed by a pair of spring legs connected at a distal side edge of the elongated member, and said mounting portion is formed by the ends of said spring legs applying pressure to the top ridge by the spring force of the legs.

* * * * *